US009640132B2

(12) United States Patent
Zhang et al.

(10) Patent No.: US 9,640,132 B2
(45) Date of Patent: May 2, 2017

(54) LIQUID CRYSTAL DISPLAY PANEL AND LIQUID CRYSTAL DISPLAY APPARATUS HAVING THE SAME

(71) Applicant: Shenzhen China Star Optoelectronics Technology Co., Ltd., Shenzhen (CN)

(72) Inventors: Xianming Zhang, Shenzhen (CN); Dan Cao, Shenzhen (CN)

(73) Assignee: Shenzhen China Star Optoelectronics Technology Co., Ltd., Shenzhen (CN)

( * ) Notice: Subject to any disclaimer, the term of this patent is extended or adjusted under 35 U.S.C. 154(b) by 18 days.

(21) Appl. No.: 14/655,338

(22) PCT Filed: Apr. 16, 2015

(86) PCT No.: PCT/CN2015/076746

§ 371 (c)(1),
(2) Date: Jun. 25, 2015

(87) PCT Pub. No.: WO2016/155043

PCT Pub. Date: Oct. 6, 2016

(65) Prior Publication Data

US 2016/0307484 A1 Oct. 20, 2016

(30) Foreign Application Priority Data

Mar. 30, 2015 (CN) ..... 2015 1 0145406

(51) Int. Cl.
*G09G 3/36* (2006.01)

(52) U.S. Cl.
CPC ..... *G09G 3/3696* (2013.01); *G09G 3/3622* (2013.01); *G09G 3/3692* (2013.01)

(58) Field of Classification Search
CPC ..... H02M 3/156; H02M 2003/156; H02M 2003/1566; G01K 7/01; Y10S 323/907; H04M 1/403; H04M 1/442; H04M 1/466; H03M 2201/8164; G09G 3/3696; G09G 3/3677; G09G 3/3674; G09G 3/3266; G09G 3/3648; G09G 2330/028; G09G 2330/021;

(Continued)

(56) References Cited

U.S. PATENT DOCUMENTS 5,982,201 A * 11/1999 Brokaw ..... H03F 3/345 323/312
2004/0150379 A1* 8/2004 Kanamori ..... H02M 3/155 323/282

(Continued)

FOREIGN PATENT DOCUMENTS

CN 104240664 12/2014

*Primary Examiner* — Grant Sitta
*Assistant Examiner* — Amen Bogale

(57) ABSTRACT

A liquid crystal display panel is disclosed and has a driving circuit, a plurality of data lines, a plurality of scanning lines, and a plurality of pixel units. The driving circuit further includes a programmable DC current source being used to output a corresponding shaping electric current according to a reference voltage, and a shaping resistor being used to generate a corresponding shaping voltage according to the outputted shaping electric current. A liquid crystal display apparatus is also disclosed. The apparatus is able to output shaping voltages with different voltage levels at the same time, thus having a better 3D display effect.

3 Claims, 2 Drawing Sheets

(58) Field of Classification Search
CPC .. G09G 2310/0264; G05F 3/245; G05F 3/242
See application file for complete search history.

(56) References Cited

U.S. PATENT DOCUMENTS

| | | | | |
|---|---|---|---|---|
| 2008/0180423 | A1* | 7/2008 | Moon | G09G 3/3648 345/204 |
| 2014/0092075 | A1* | 4/2014 | Lee | G05F 1/468 345/212 |
| 2016/0078797 | A1 | 3/2016 | Chen et al. | |

* cited by examiner

LIQUID CRYSTAL DISPLAY PANEL AND LIQUID CRYSTAL DISPLAY APPARATUS HAVING THE SAME

RELATED APPLICATIONS

This application is a National Phase of PCT Patent Application No. PCT/CN2015/076746 having International filing date of Apr. 16, 2015, which claims the benefit of priority of Chinese Patent Application No. 201510145406.3 filed on Mar. 30, 2015. The contents of the above applications are all incorporated by reference as if fully set forth herein in their entirety.

BACKGROUND OF THE INVENTION

Field of the Invention

The present invention relates to the field of liquid crystal display, and more particularly to a liquid crystal display panel and a liquid crystal display apparatus having the same.

Description of the Related Art

With the development of technologies, more and more people use liquid crystal display apparatuses and the requirement for quality of liquid crystal display panel is also becoming constantly higher. A conventional liquid crystal display panel includes a plurality of pixel units, data lines, scanning lines, and driving circuits. The driving circuits provide data signals to the data lines, and provide scanning signals to the scanning lines; the pixel units display images with the data signals under the control of the scanning signals.

During the display process of the liquid crystal display apparatus, a surge of the scanning signals on the scanning lines will affect the data signals, therefore a shaping voltage will be provided on the driving circuits to eliminate the influence the scanning signals have on the data signals.

For a liquid crystal display apparatus having a 3D display mode, the liquid crystal display apparatus has to display multiple images at the same time. However, the shaping voltage for each one of the images is different. The driving circuits of the conventional liquid crystal display panel is unable to simultaneously output different shaping voltages, thereby resulting in a mediocre 3D display effect for the liquid crystal display panel.

Therefore, it is necessary to provide a liquid crystal display panel and a liquid crystal display apparatus having the same to overcome the problems existing in the conventional technology.

SUMMARY OF THE INVENTION

A main object of the present invention is to provide a liquid crystal display panel and a liquid crystal display apparatus having the same that are able to simultaneously output different shaping voltages and thus have a better 3D display effect so as to solve the technical problems where the driving circuit of the conventional liquid crystal display panel and the liquid crystal display apparatus cannot simultaneously output different shaping voltages and result in a mediocre 3D display effect.

The prevent invention provides a liquid crystal display panel having:

a driving circuit being used to provide data signals and scanning signals;

a plurality of data lines being used to transmit the data signals;

a plurality of scanning lines being used to transmit the scanning signals; and a plurality of pixel units being used to display images by using the data signals under the control of the scanning signals;

wherein the driving circuit includes:

a programmable DC current source being used to output a corresponding shaping electric current according to a reference voltage; and a shaping resistor being used to generate a corresponding shaping voltage according to the outputted shaping electric current; wherein the shaping voltage is used to perform a shaping effect on the corresponding scanning signal;

wherein the programmable DC current source is a constant current source; the driving circuit uses the reference voltage of different voltage levels for different image signals so as to generate the corresponding shaping voltages.

In the liquid crystal display panel of the present invention, the constant current source includes a first transistor, a second transistor, a first load resistance and a second load resistance;

an emitter of the first transistor is connected to an end of the first load resistance and the ground; a collector of the first transistor is connected to an end of the second load resistance and a base of the second transistor; a base of the first transistor is connected to another end of the first load resistance and an emitter of the second transistor; a collector of the second transistor outputs the shaping electric currents; another end of the second load resistance is connected to receive the reference voltage.

In the liquid crystal display panel of the present invention, the first transistor is a PNP transistor.

In the liquid crystal display panel of the present invention, the second transistor is a PNP transistor.

The present invention further provides a liquid crystal display panel having:

a driving circuit being used to provide data signals and scanning signals;

a plurality of data lines being used to transmit the data signals;

a plurality of scanning lines being used to transmit the scanning signals; and a plurality of pixel units being used to display images by using the data signals under the control of the scanning signals;

wherein the driving circuit includes:

a programmable DC current source being used to output a corresponding shaping electric current according to a reference voltage; and a shaping resistor being used to generate a corresponding shaping voltage according to the outputted shaping electric current; wherein the shaping voltage is used to perform a shaping effect on the corresponding scanning signal.

In the liquid crystal display panel of the present invention, the programmable DC current source is a constant current source.

In the liquid crystal display panel of the present invention, the constant current source includes a first transistor, a second transistor, a first load resistance and a second load resistance;

an emitter of the first transistor is connected to an end of the first load resistance and the ground; a collector of the first transistor is connected to an end of the second load resistance and a base of the second transistor; a base of the first transistor is connected to another end of the first load resistance and an emitter of the second transistor; a collector of the second transistor outputs the shaping electric currents;

another end of the second load resistance is connected to receive the reference voltage.

In the liquid crystal display panel of the present invention, the first transistor is a PNP transistor.

In the liquid crystal display panel of the present invention, the second transistor is a PNP transistor.

In the liquid crystal display panel of the present invention, the driving circuit uses the reference voltage of different voltage levels for different image signals so as to generate the corresponding shaping voltages.

The present invention further provides a liquid crystal display apparatus having a liquid crystal display panel and a backlight source. The liquid crystal display panel has:

a driving circuit being used to provide data signals and scanning signals;

a plurality of data lines being used to transmit the data signals;

a plurality of scanning lines being used to transmit the scanning signals; and a plurality of pixel units being used to display images by using the data signals under the control of the scanning signals;

wherein the driving circuit includes:

a programmable DC current source being used to output a corresponding shaping electric current according to a reference voltage; and a shaping resistor being used to generate a corresponding shaping voltage according to the outputted shaping electric current; wherein the shaping voltage is used to perform a shaping effect on the corresponding scanning signal.

In the liquid crystal display apparatus of the present invention, the programmable DC current source is a constant current source.

In the liquid crystal display apparatus of the present invention, the constant current source includes a first transistor, a second transistor, a first load resistance and a second load resistance;

an emitter of the first transistor is connected to an end of the first load resistance and the ground; a collector of the first transistor is connected to an end of the second load resistance and a base of the second transistor; a base of the first transistor is connected to another end of the first load resistance and an emitter of the second transistor; a collector of the second transistor outputs the shaping electric currents; another end of the second load resistance is connected to receive the reference voltage.

In the liquid crystal display apparatus of the present invention, the first transistor is a PNP transistor.

In the liquid crystal display apparatus of the present invention, the second transistor is a PNP transistor.

In the liquid crystal display apparatus of the present invention, the driving circuit uses the reference voltage of different voltage levels for different image signals so as to generate the corresponding shaping voltages.

Compared with the conventional liquid crystal display panel and liquid crystal display apparatus, the liquid crystal display panel and liquid crystal display apparatus of the present invention, with the programmable DC current source, can output shaping voltages with different voltage levels at the same time, thus having a better 3D display effect, and thereby solving the technical problems where the driving circuit of the conventional liquid crystal display panel and the liquid crystal display apparatus cannot simultaneously output different shaping voltages and result in a mediocre 3D display effect.

In order to make the contents of the present invention more easily understood, the preferred embodiments of the present invention are described in detail, in cooperation with accompanying drawings, as follows.

DETAILED DESCRIPTION OF THE PREFERRED EMBODIMENTS

The foregoing objects, features and advantages adopted by the present invention can be best understood by referring to the following detailed description of the preferred embodiments and the accompanying drawings. Furthermore, the directional terms described in the present invention, such as upper, lower, front, rear, left, right, inner, outer, side, etc., are only directions with reference to the accompanying drawings, so that the used directional terms are used to describe and understand the present invention, but the present invention is not limited thereto.

Figure 1:
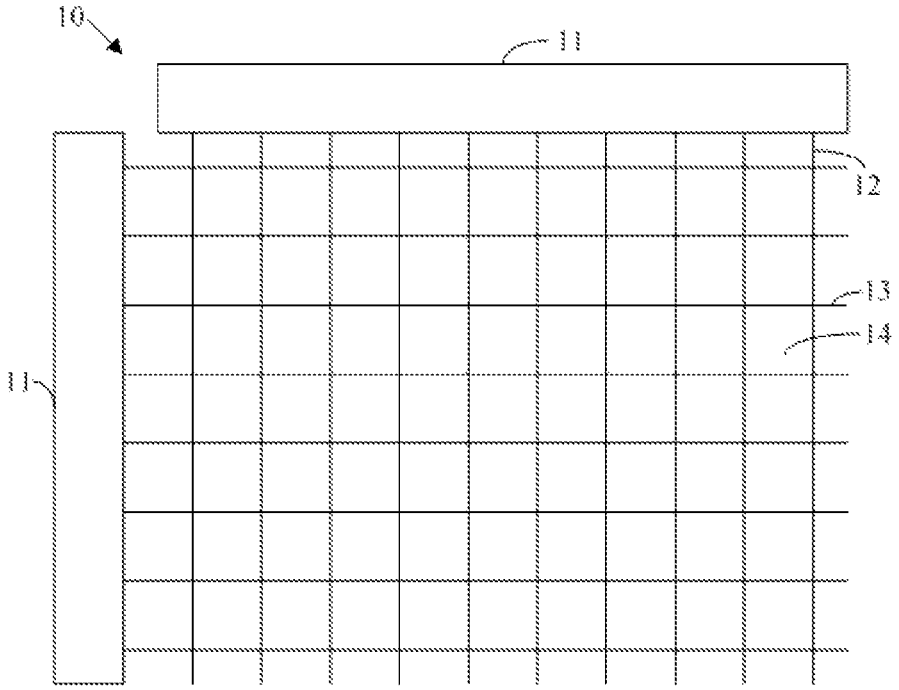
FIG. 1 is a schematic diagram of the structure of a liquid crystal display panel according to a preferred embodiment of the present invention.

With reference to FIG. 1, FIG. 1 is a schematic diagram of the structure of a liquid crystal display panel according to a preferred embodiment of the present invention. The liquid crystal display panel 10 of the present embodiment includes a driving circuit 11, a plurality of data lines 12, a plurality of scanning lines 13 and a plurality of pixel units 14. The driving circuit 11 is used to provide data signals and scanning signals. The data lines 12 are used to transmit the data signals. The scanning lines 13 are used to transmit the scanning signals. The pixel units 14 are used to display images by using the data signals under the control of the scanning signals.

Figure 2:
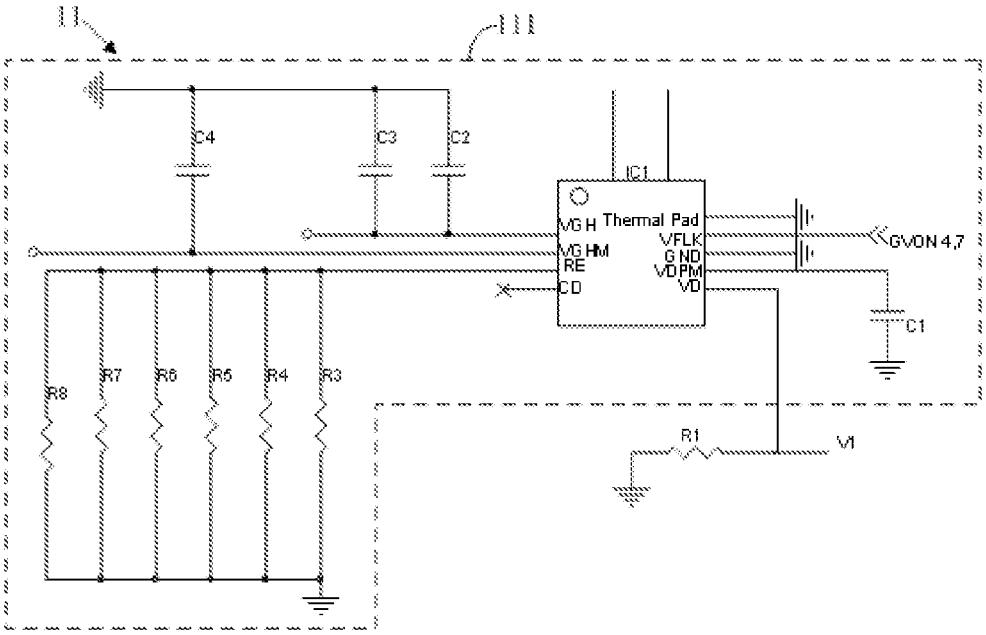
FIG. 2 is a circuit diagram of a driving circuit of the liquid crystal display panel according to the preferred embodiment of the present invention.

With further reference to FIG. 2, FIG. 2 is a circuit diagram of a driving circuit of the liquid crystal display panel according to the preferred embodiment of the present invention, wherein the driving circuit 11 includes a programmable DC current source 111 and a shaping resistor R1. The programmable DC current source 111 is used to use reference voltages VCC with different voltage levels to output corresponding shaping electric current. The shaping resistor R1 is used to generate a corresponding shaping voltage V1 according to the shaping electric current outputted from the programmable DC current source 111. The shaping voltage V1 is used to perform a shaping effect on the corresponding scanning signal transmitted on the corresponding scanning line 13, and thereby avoiding the influence the surge of the scanning signals have on the data signals. A processing chip IC1 generates shaping electric current under the control of resistance R3 to R8 and capacitors C2 to C4. The shaping voltage V1 is generated when the shaping electric current passes through the shaping resistor R1. The programmable DC current source 111 herein is preferably a constant current source.

Figure 3:
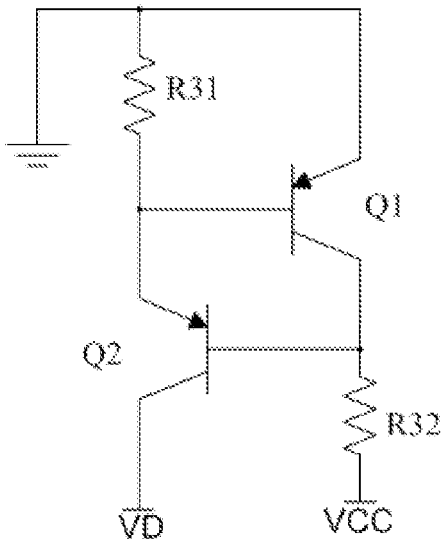
FIG. 3 is a circuit diagram of a partial structure of a programmable DC current source in the driving circuit of the liquid crystal display panel according to the preferred embodiment of the present invention.

The structure of the constant current source may be implemented as shown in FIG. 3. FIG. 3 is a circuit diagram of a partial structure of a programmable DC current source in the driving circuit of the liquid crystal display panel according to the preferred embodiment of the present invention. The constant current source includes a first transistor Q1, a second transistor Q2, a first load resistance R31 and a second load resistance R32.

An emitter of the first transistor Q1 is connected to an end of the first load resistance R31 and the ground. A collector of the first transistor Q1 is connected to an end of the second load resistance R32 and a base of the second transistor Q2. A base of the first transistor Q1 is connected to another end of the first load resistance R31 and an emitter of the second transistor Q2. A collector of the second transistor Q2 outputs the shaping electric currents. Another end of the second load resistance R32 is connected to receive the reference voltage VCC. The first transistor Q1 and the second transistor Q2 herein are all PNP transistors. Other structures of constant current source can also be used herein. The structure of the constant current source may be mounted inside or outside the processing chip IC1.

The shaping electric current outputted from the programmable DC current source 111 of the preferred embodiment only relates to the reference voltage VCC, the first load resistance R31 and the second load resistance R32. Under a condition where the first load resistance R31 and the second load resistance R32 have fixed values, the shaping electric current only relates to the reference voltage VCC, therefore the driving circuit 11 can use the reference voltage VCC with different voltage levels to generate the shaping voltages with different voltage levels.

When the liquid crystal display panel 10 of the present invention is working, the driving circuit 11 can confirm the data signals, the scanning signals and the shaping voltages based on the display mode of the liquid crystal display panel 10. If the liquid crystal display panel 10 is at a 3D display mode, meaning that the liquid crystal display panel 10 needs to display multiple images at the same time, the driving circuit 11 can decide shaping voltages V1 with different voltage levels according to the data signals of different images; that is to decide the different reference voltages VCC of the programmable DC current source 111. Thus, the driving circuit 11 can provide different shaping voltages V1 to different scanning lines 13 so as to perform an optimal shaping treatment on the scanning signals for different images, thereby avoiding the influence the surge of the scanning signals have on the data signals. Since the shaping voltage V1 only relates to the reference voltage VCC, the driving circuit 11 only has to adjust the voltage level of the reference voltage VCC in the programmable DC current sources 111 to easily perform optimal shaping treatment on the scanning signals, which process is fast with low cost.

Thus, the liquid crystal display panel of the present embodiment, with the mounting of the programmable DC current source, can output shaping voltages with different voltage levels at the same time, thus having a better 3D display effect.

The prevent invention further provides a liquid crystal display apparatus. The liquid crystal display apparatus includes a liquid crystal display panel and a backlight source. The liquid crystal display panel includes a driving circuit, a plurality of data lines, a plurality of scanning lines, and a plurality of pixel units. The driving circuit is used to provide data signals and scanning signals. The data lines are used to transmit the data signals. The scanning lines are used to transmit the scanning signals. The pixel units are used to display images by using the data signals under the control of the scanning signals. The driving circuit includes a programmable DC current source and a shaping resistor. The programmable DC current source is used to output a corresponding shaping electric current according to a reference voltage. The shaping resistor is used to generate a corresponding shaping voltage according to the outputted shaping electric current, wherein the shaping voltage is used to perform a shaping effect on the corresponding scanning signal.

Preferably, the programmable DC current source is a constant current source.

Preferably, the constant current source includes a first transistor, a second transistor, a first load resistance and a second load resistance.

An emitter of the first transistor is connected to an end of the first load resistance and the ground; a collector of the first transistor is connected to an end of the second load resistance and a base of the second transistor; a base of the first transistor is connected to another end of the first load resistance and an emitter of the second transistor; a collector of the second transistor outputs the shaping electric currents; another end of the second load resistance is connected to receive the reference voltage. The first transistor and the second transistor herein are PNP transistors.

Preferably, the driving circuit uses the reference voltage of different voltage levels for different image signals so as to generate the corresponding shaping voltages.

The working theory and advantages of the liquid crystal display apparatus of the present invention is the same as the above-mentioned specific embodiments of the liquid crystal display panel, therefore please refer to the foregoing embodiments for understanding the specific structure of the liquid crystal display apparatus.

By the above description, it is known that the liquid crystal display panel and liquid crystal display apparatus of the present invention, with the programmable DC current source, are able to output shaping voltages with different voltage levels at the same time, thus having a better 3D display effect, and thereby solving the technical problems where the driving circuit of the conventional liquid crystal display panel and the liquid crystal display apparatus cannot simultaneously output different shaping voltages and result in a mediocre 3D display effect.

The present invention has been described with preferred embodiments thereof, and it is understood that many changes and modifications to the described embodiment can be carried out without departing from the scope and the spirit of the invention that is intended to be limited only by the appended claims.

What is claimed is:

1. A liquid crystal display panel comprising:

a driving circuit being used to provide data signals and scanning signals;

a plurality of data lines being used to transmit the data signals;

a plurality of scanning lines being used to transmit the scanning signals; and a plurality of pixel units being used to display images by using the data signals under the control of the scanning signals;

wherein the driving circuit includes:

a programmable DC current source being used to output a corresponding shaping electric current according to a reference voltage; and a shaping resistor being used to generate a corresponding shaping voltage according to the outputted shaping electric current;

wherein the corresponding shaping voltage is used to perform a shaping effect on the scanning signal;

wherein the programmable DC current source is a constant current source, wherein the constant current source includes a first transistor, a second transistor, a first load resistance and a second load resistance;

an emitter of the first transistor is connected to an end of the first load resistance and the ground;

a collector of the first transistor is connected to an end of the second load resistance and a base of the second transistor;

a base of the first transistor is connected to another end of the first load resistance and an emitter of the second transistor;

a collector of the second transistor outputs the corresponding shaping electric current;

another end of the second load resistance is connected to receive the reference voltage, wherein the first transistor is a PNP transistor; the second transistor is a PNP transistor;

the driving circuit uses the reference voltage of different voltage levels for different image signals so as to generate the corresponding shaping voltages.

2. A liquid crystal display apparatus comprising a liquid crystal display panel and a backlight source, wherein the liquid crystal display panel includes:

a driving circuit being used to provide data signals and scanning signals;

a plurality of data lines being used to transmit the data signals;

a plurality of scanning lines being used to transmit the scanning signals; and a plurality of pixel units being used to display images by using the data signals under the control of the scanning signals;

wherein the driving circuit includes:

a programmable DC current source being used to output a corresponding shaping electric current according to a reference voltage; and a shaping resistor being used to generate a corresponding shaping voltage according to the outputted shaping electric current;

wherein the corresponding shaping voltage is used to perform a shaping effect on the scanning signal;

wherein the programmable DC current source is a constant current source;

the constant current source includes a first transistor, a second transistor, a first load resistance end a second load resistance;

an emitter of the first transistor is connected to an end of the first load resistance and the ground;

a collector of the first transistor is connected to an end of the second load resistance and a base of the second transistor;

a base of the first transistor is connected to another end of the first load resistance and an emitter of the second transistor;

a collector of the second transistor outputs the corresponding shaping electric current;

another end of the second load resistance is connected to receive the reference voltage, wherein the first transistor is a PNP transistor; and the second transistor is a PNP transistor.

3. The liquid crystal display apparatus as claimed in claim 2, wherein the driving circuit uses the reference voltage of different voltage levels for different image signals so as to generate the corresponding shaping voltages.

* * * * *